US011987979B2

(12) United States Patent
Gosling et al.

(10) Patent No.: US 11,987,979 B2
(45) Date of Patent: May 21, 2024

(54) PREFABRICATED WALL MODULE LEVELING ASSEMBLY

(71) Applicant: DIRTT ENVIRONMENTAL SOLUTIONS LTD., Calgary (CA)

(72) Inventors: Geoff W. Gosling, Calgary (CA); Thomas A. Brown, Calgary (CA); Jeremy J. Klaas, Green Bay, WI (US)

(73) Assignee: DIRTT ENVIRONMENTAL SOLUTIONS LTD., Calgary (CA)

( * ) Notice: Subject to any disclaimer, the term of this patent is extended or adjusted under 35 U.S.C. 154(b) by 172 days.

(21) Appl. No.: 17/320,006

(22) Filed: May 13, 2021

(65) Prior Publication Data

US 2021/0355677 A1 Nov. 18, 2021

Related U.S. Application Data

(60) Provisional application No. 63/025,789, filed on May 15, 2020.

(51) Int. Cl.
*E04B 2/74* (2006.01)

(52) U.S. Cl.
CPC .... *E04B 2/7427* (2013.01); *E04B 2002/7487* (2013.01); *E04B 2002/749* (2013.01)

(58) Field of Classification Search
CPC ..... E04B 2002/749; E04B 2002/7487; E04B 2002/7492; E04B 2002/7496; E04B 2/74; E04B 2/7405; E04B 2/7407; E04B 2/7416; E04B 2/7427; E04B 2/7433; E04B 2/7448
See application file for complete search history.

(56) References Cited

U.S. PATENT DOCUMENTS 2,570,282 A * 10/1951 Speck ..... E04F 15/0247 248/354.3
3,411,252 A * 11/1968 Boyle, Jr. ..... E04B 2/825 52/468
3,537,217 A * 11/1970 Lickliter ..... E04B 2/825 52/762
3,885,361 A * 5/1975 De Schutter ..... E04B 2/78 52/242
4,449,337 A * 5/1984 Gzym ..... E04B 2/825 52/242
4,516,619 A * 5/1985 Hasbrouck ..... E04B 2/7425 52/239
5,138,814 A * 8/1992 Giles ..... E04B 2/7425 403/402
5,974,742 A * 11/1999 Schreiner ..... A47B 21/06 52/239
7,958,684 B2 * 6/2011 Kleege ..... E04B 2/827 52/506.08

* cited by examiner

*Primary Examiner* — Jessica L Laux
(74) *Attorney, Agent, or Firm* — Workman Nydegger

(57) ABSTRACT

A leveling stud includes a threaded body extending between a top end and a bottom end thereof. The bottom end has a flat bottom surface and a dig protrusion extending from a portion of the flat bottom surface. The dig protrusion is configured to dig into a channel surface of a base track of a prefabricated wall system when the leveling stud is threaded into a positioning nut of the base track. The flat bottom surface is also configured to abut the channel surface when the leveling stud is threaded into the positioning nut.

20 Claims, 7 Drawing Sheets

PREFABRICATED WALL MODULE LEVELING ASSEMBLY

CROSS-REFERENCE TO RELATED APPLICATIONS

This application claims the benefit of and priority to U.S. Provisional Patent Application Ser. No. 63/025,789 filed on May 15, 2020 and entitled "Prefabricated Wall Module Leveling Assembly," which application is expressly incorporated herein by reference in its entirety.

BACKGROUND

Businesses and other organizations frequently operate from an office. The amount a business or organization pays for the office space depends on several factors, including the location of the office space and the size of the office space. Office or other commercial space is rarely used undivided, but rather is frequently divided into smaller components. For example, interior office space is sometimes partitioned into smaller areas, such as conference rooms, offices, cubicles, and the like. Furthermore, other interior spaces (e.g., residential spaces) can be divided into partitions for various purposes.

Interior spaces can be divided utilizing prefabricated wall systems (e.g., modular wall systems) that include one or more prefabricated wall modules. The prefabricated wall modules can be arranged/secured adjacent to one another to form interior partitions, such as office cubicles, rooms, etc. The prefabricated wall modules can affix to ceiling (e.g., ceiling track(s)) and floor connection components (e.g., floor/base track(s)) to provide stable partitioning walls.

Many interior spaces, however, lack a uniformly level floor upon which prefabricated wall systems can rest. Consequently, some prefabricated wall systems implement leveling apparatuses to enable leveling of the prefabricated wall modules within the prefabricated wall system.

Many conventional leveling apparatuses are configured to operate from a fixed location within a floor/base track or prefabricated wall module of a prefabricated wall system. Although such leveling apparatuses can prove stable, they often fail to provide sufficient versatility to accommodate variations in floor levelness of different installation spaces.

Some conventional leveling apparatuses are configured to operate from many different locations within a floor/base track or prefabricated wall module of a prefabricated wall system (e.g., by being slidable within a floor track or prefabricated wall module). Although such leveling apparatuses can provide versatility to accommodate different levelness conditions, they often fail to provide sufficient stability to the prefabricated wall system. For example, slidable leveling apparatuses can be unsuitable for installation spaces that experience seismic activity and/or other vibration events.

Accordingly, there are a number of difficulties associated with levelers in prefabricated wall systems that can be addressed.

The subject matter claimed herein is not limited to embodiments that solve any disadvantages or that operate only in environments such as those described above. Rather, this background is only provided to illustrate one exemplary technology area where some embodiments described herein may be practiced.

BRIEF SUMMARY

Implementations of the present invention extend to systems, apparatuses, and components for forming, assembling, and installing a prefabricated wall module leveling assembly. More specifically, the present invention relates to slidable prefabricated wall module leveling assemblies and components that are suitable for environments that experience seismic activity and/or other vibration events.

For example, at least one embodiment includes a leveling stud with a threaded body extending between a top end and a bottom end thereof, the bottom end having a flat bottom surface and a dig protrusion extending from a portion of the flat bottom surface, wherein the dig protrusion is configured to dig into a channel surface of a base track of a prefabricated wall system when the leveling stud is threaded into a positioning nut, and wherein the flat bottom surface is configured to abut the channel surface when the leveling stud is threaded into the positioning nut of the base track.

In another example embodiment, a prefabricated wall module leveling assembly includes a leveling stud and a positioning nut. The leveling stud has a threaded body with a first threaded section and a second threaded section, a top end and a bottom end, the threaded body extending between the top end and the bottom end, and the bottom end having a flat bottom surface, wherein a diameter of the second threaded section is greater than a diameter of the first threaded section. The positioning nut has an opening extending therethrough, the opening having interior threads that correspond to threads of the first threaded section of the leveling stud.

Another embodiment includes a prefabricated wall system having at least one prefabricated wall module with a wall panel having a bottom edge, a top edge, and opposing vertical edges, vertical extrusions that receive and secure to the opposing vertical edges, and a base extrusion that receives and secures to the bottom edge, the base extrusion defining a leveling channel. The prefabricated wall system also includes a leveling collar retained within the leveling channel, the leveling collar being slidable along a length of the leveling channel and having an opening extending therethrough, the opening including a threaded section and an unthreaded section. A leveling stud is also included, the leveling stud having a threaded body with a first threaded section and a second threaded section above the first threaded section, wherein the threads of the second threaded section are threaded through the threaded section of the leveling collar and the first threaded section extends below the leveling collar when installed. The leveling stud also includes a top end and a bottom end, the threaded body extending between the top end and the bottom end and the bottom end having a flat bottom surface and a dig protrusion extending from a portion of the flat bottom surface.

The embodiments disclosed and claimed herein can provide prefabricated wall module leveling components in an advantageous manner. For instance, components of the prefabricated wall module leveling assemblies of the present disclosure can be slidable within a prefabricated wall system to accommodate variations in installation spaces. Notwithstanding being slidable, the prefabricated wall module leveling assemblies of the present disclosure can be lockable in place upon installation (in a low-height manner), making them suitable for installation spaces that experience seismic activity and/or other vibration events.

This Summary is provided to introduce a selection of concepts in a simplified form that are further described below in the Detailed Description. This Summary is not intended to identify key features or essential features of the claimed subject matter, nor is it intended to be used as an aid in determining the scope of the claimed subject matter.

Additional features and advantages will be set forth in the description which follows, and in part will be apparent to one of ordinary skill in the art from the description, or may be learned by the practice of the teachings herein. Features and advantages of embodiments described herein may be realized and obtained by means of the instruments and combinations particularly pointed out in the appended claims. Features of the embodiments described herein will become more fully apparent from the following description and appended claims.

BRIEF DESCRIPTION OF THE DRAWINGS

To further clarify the above and other features of the embodiments described herein, a more particular description will be rendered by reference to the appended drawings. It is appreciated that these drawings depict only examples of the embodiments described herein and are therefore not to be considered limiting of its scope. The embodiments will be described and explained with additional specificity and detail through the use of the accompanying drawings in which.

DETAILED DESCRIPTION

Figure 1:
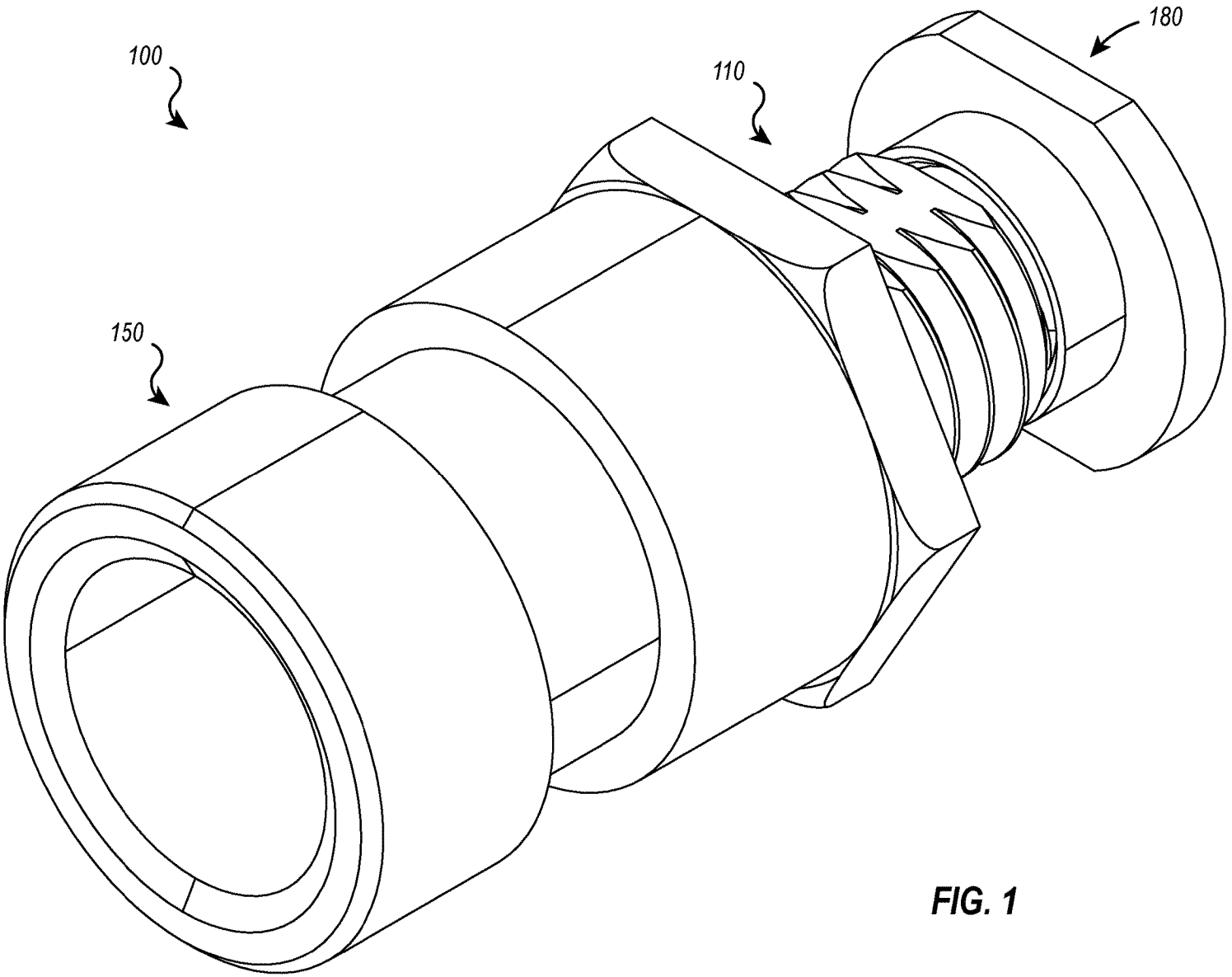
FIG. 1 illustrates a perspective view of a prefabricated wall module leveling assembly, in accordance with implementations of the present disclosure.

Implementations of the present invention extend to systems, apparatuses, and components for forming, assembling, and installing a prefabricated wall module leveling assembly. More specifically, the present invention relates to slidable prefabricated wall module leveling assemblies and components that are suitable for environments that experience seismic activity and/or other vibration events.

For example, a leveling stud can comprise a threaded body extending between a top end and a bottom end thereof. The bottom end can include a flat bottom surface and a dig protrusion extending from a portion of the flat bottom surface. The dig protrusion can be configured to dig into a channel surface of a base track of a prefabricated wall system when the leveling stud is threaded into a positioning nut. The flat bottom surface can also be configured to abut the channel surface when the leveling stud is threaded into the positioning nut of the base track.

In another example, a prefabricated wall module leveling assembly comprises a leveling stud and a positioning nut. The leveling stud can include a threaded body that has a first threaded section and a second threaded section. The diameter of the second threaded section can be greater than the diameter of the first threaded section. The threaded body can also include a top end and a bottom end, with the threaded body extending between the top end and the bottom end. The bottom end can include a flat bottom surface and a dig protrusion extending from a portion of the flat bottom surface.

The positioning nut can include a positioning nut opening that extends through the positioning nut. The positioning nut opening can include interior threads that correspond to threads of the first threaded section of the leveling stud.

In yet another example, a prefabricated wall system includes a prefabricated wall module, a leveling collar, and a leveling stud. The prefabricated wall module can include a wall panel that has a bottom edge, a top edge, and opposing vertical edges. The prefabricated wall module can also include vertical extrusions that receive and secure to the opposing vertical edges. The prefabricated wall module can further include a base extrusion that receives and secures to the bottom edge. The base extrusion can include a leveling channel.

The leveling collar of the prefabricated wall system can be retained within the leveling channel of the base extrusion and can be slidable along the length of the leveling channel. The leveling collar can include a leveling collar opening extending through the leveling collar. The leveling collar can include an unthreaded section and a threaded section.

The leveling stud of the prefabricated wall system can include a threaded body. The threaded body can comprise a first threaded section and a second threaded section above the first threaded section. The threads of the second threaded section can be threaded through the threaded section of the leveling collar, and the first threaded section can extend below the leveling collar. The threaded body can also include a top end and a bottom end, with the threaded body extending between the top end and the bottom end. The bottom end can include a flat bottom surface and a dig protrusion extending from a portion of the flat bottom surface.

The embodiments disclosed and claimed herein can provide prefabricated wall module leveling components in an advantageous manner. For instance, components of the prefabricated wall module leveling assemblies of the present disclosure can be slidable within a prefabricated wall system (e.g., within a base extrusion of a prefabricated wall module and/or within a base track installed in an installation space). With slidable components, the prefabricated wall systems of the present disclosure can accommodate variations in installation spaces.

In addition to having slidable components, the prefabricated wall module leveling assemblies of the present disclosure can be lockable in place upon installation, making them suitable for installation spaces that experience seismic activity and/or other vibration events. The prefabricated wall module leveling assemblies of the present disclosure can be lockable in a low-height manner, such as by digging a dig protrusion of a leveling stud into a surface of a base extrusion. Thus, the prefabricated wall module leveling assemblies of the present disclosure can advantageously enable a wide range of leveling heights.

FIG. 1 illustrates a perspective view of a prefabricated wall module leveling assembly 100. The prefabricated wall module leveling assembly 100 can include a leveling stud 110, a leveling collar 150, and a positioning nut 180.

Figure 2:
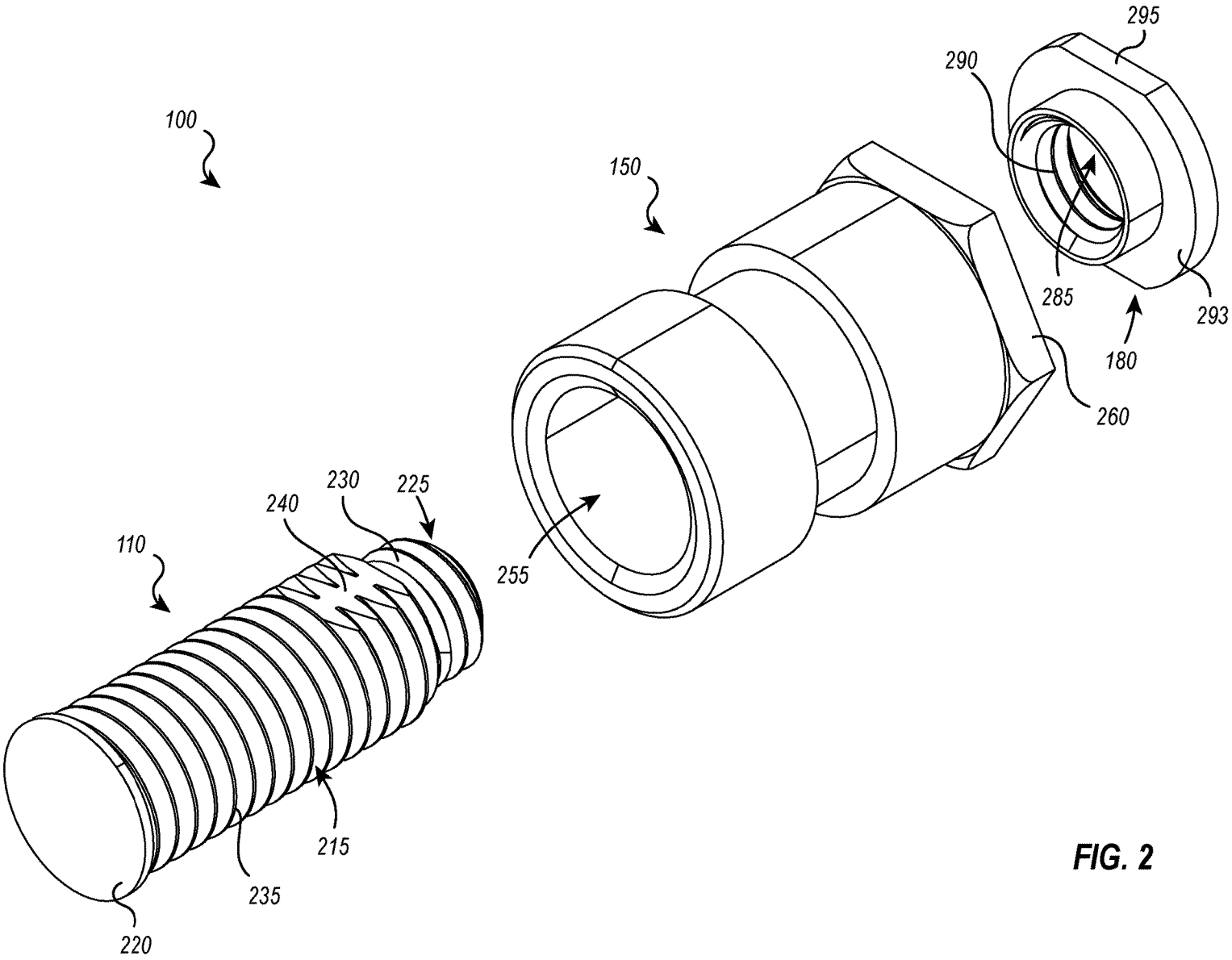
FIG. 2 illustrates an exploded perspective view of a prefabricated wall module leveling assembly, in accordance with implementations of the present disclosure.

FIG. 2 illustrates an exploded perspective view of a prefabricated wall module leveling assembly 100 depicted in FIG. 1. FIG. 2 demonstrates that the leveling stud 110 can include a threaded body 215 that extends between a top end 220 and a bottom end 225 of the leveling stud 110. The threaded body 215 can comprise a first threaded section 230 and a second threaded section 235. The first and second threaded sections 230, 235 can have differing diameters. For instance, FIG. 2 illustrates the second threaded section 235 having a diameter that is greater than the diameter of the first threaded section 230.

Although FIG. 2 focuses, in some respects, on implementations in which the leveling stud has two different threaded sections along its threaded body, those skilled in the art will recognize, in view of the present disclosure, that a leveling stud can have a single threaded section along its threaded body, which can comprise substantially uniform diameter (accounting for the threads).

FIG. 2 illustrates that the positioning nut 180 includes a positioning nut opening 285 extending through the positioning nut 180. The positioning nut opening 285 can include interior threads 290 that correspond to the threads of the first threaded section 230 of the leveling stud 110, enabling the leveling stud 110 to thread into the positioning nut 180 via the corresponding threads.

The positioning nut 180 can also include a radial protrusion 293 that extends away from the positioning nut opening 285. The radial protrusion 293 can also include opposing flattened edges 295 on opposing lateral sides of the positioning nut 180. The opposing flattened edges 295 can be configured to abut channel surfaces 420 of a base track 405 to prevent rotation of the positioning nut within a base track channel when installed therein (see FIG. 4).

FIG. 2 shows that, in some implementations, a segment of the second threaded section 235 can include opposing flattened portions 240 (see also FIG. 3) on opposing lateral sides of the second threaded section 235. The opposing flattened portions 240 can, in some instances, provide engagement surfaces that enable the leveling stud 110 to interface/engage with a tool for rotating the leveling stud 110. In this regard, the opposing flattened portions 240 of the second threaded section 235 can facilitate threading the leveling stud 110 into the positioning nut 180.

By way of non-limiting example, in some instances, a user can employ a wrench (e.g., an open-end wrench, such as a ½-inch wrench) to engage the flattened portions 240 of the second threaded section 235 to thread the leveling stud 110 into the interior threads 290 of the positioning nut opening 285 of the positioning nut 180.

Figure 3:
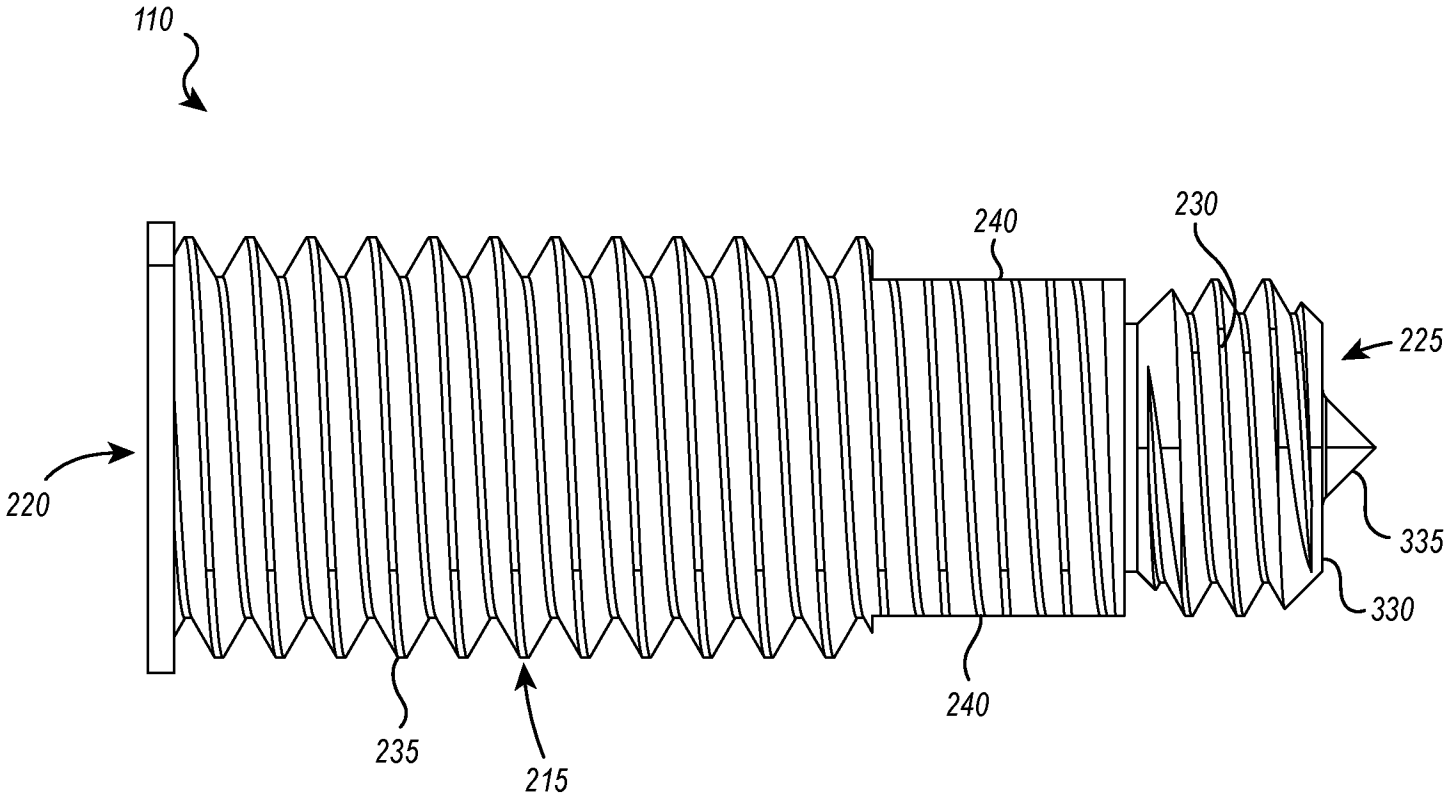
FIG. 3 illustrates a side view of a leveling stud of a prefabricated wall module leveling assembly, in accordance with implementations of the present disclosure.

Although FIGS. 2 and 3 focus, in some respects, on a leveling stud 110 that includes two opposing flattened portions 240 on opposing lateral sides of the second threaded section, those skilled in the art will recognize, in view of the present disclosure, that a leveling stud 110 can include any number of flattened portions to facilitate engagement with tools for rotating the leveling stud 110 (e.g., three or more flattened portions). Alternatively, leveling stud 110 can include another means for tool engagement thereupon, such as a hexagonal hole in one or more sides thereof to allow for use of a hex wrench to rotate leveling stud 110.

FIG. 2 also depicts the leveling collar 150. The leveling collar 150 can include a leveling collar opening 255 that extends through the leveling collar 150. The leveling collar opening 255 can include a threaded section 660 (see FIG. 6) with interior threads that correspond to the threads of the second threaded section 235 of the leveling stud 110. Accordingly, the leveling stud 110 can thread through both the leveling collar 150 (with the second threaded section 235 of the leveling stud) and the positioning nut 180 (with the first threaded section 230).

Implementations of leveling stud 110 that include first and second threaded sections 230, 235 having different diameters, as shown in FIGS. 2 and 3, thus prevent improper installation by ensuring that first threaded section 230 is only compatible with positioning nut opening 285 and second threaded section 235 is only compatible with leveling collar opening 255. Alternatively, implementations can include first and second threaded sections 230, 235 having different thread pitches.

In some implementations, the leveling collar 150 comprises a tool interface 260 that at least partially surrounds a portion of the leveling collar 150. FIG. 2 illustrates the tool interface 260 as a hexagonal interface that surrounds the bottom portion of the leveling collar 150. Thus, in some instances, a user can operate a tool (e.g., a thin-profile wrench) to engage with the tool interface 260 of the leveling collar 150 to rotate the leveling collar 150 about the leveling stud 110, thereby adjusting the relative positioning of the leveling collar 150 and the leveling stud 110 (e.g., by advancing or retracting the leveling collar 150 along the leveling stud 110 via the corresponding threads, see FIG. 7).

FIG. 2 illustrates that, in some implementations, the top end 220 of the leveling stud 110 omits any tool engagement interface, which can save on processing for manufacturing a leveling stud 110. In some instances, a tool engagement surface is unnecessary on the top end 220 of the leveling stud 110 because the top end 220 of the leveling stud 110 is concealed within the leveling collar 150 and below a prefabricated wall module when a user installs/operates a prefabricated wall module leveling assembly 100 of the present disclosure. Furthermore, the other tool interfaces of the prefabricated wall module leveling assembly 100 described herein (opposing flattened portions 240, tool interface 260) can enable a user to carry out all needed actuation of the prefabricated wall module leveling assembly 100. Alternatively, top end 220 can include a tool interface such as, for example, a hexagonal hole for interfacing a hex wrench.

FIG. 3 illustrates a side view of a leveling stud 110 of a prefabricated wall module leveling assembly 100. FIG. 3 demonstrates that the bottom end 225 of the leveling stud 110 can include a flat bottom surface 330 and a dig protrusion 335. The dig protrusion 335 can extend from the flat bottom surface 330 of the bottom end 225 of the leveling stud 110. The dig protrusion 335 can include a tapered profile with a point that can facilitate digging into an adjacent material when appropriate force is applied (e.g., by rotating the leveling stud 110 through the positioning nut 180, see FIGS. 5 and 6). For instance, the dig protrusion 335 can be configured to dig into a channel surface of a base track 405 (see FIG. 6).

Those skilled in the art will recognize that the dig protrusion can take on various forms and/or configurations in various implementations. For instance, FIG. 3 depicts a dig protrusion 335 that omits threads and includes a smooth conical shape that converges to a dig point. In other implementations, the dig protrusion 335 comprises threads that converge to a dig point for digging into the channel surface of the base track 405. In yet other implementations the dig protrusion 335 comprises a boring bit for boring out a portion of the channel surface of the base track 405, within which the dig protrusion 335 can reside after boring.

Figure 4:
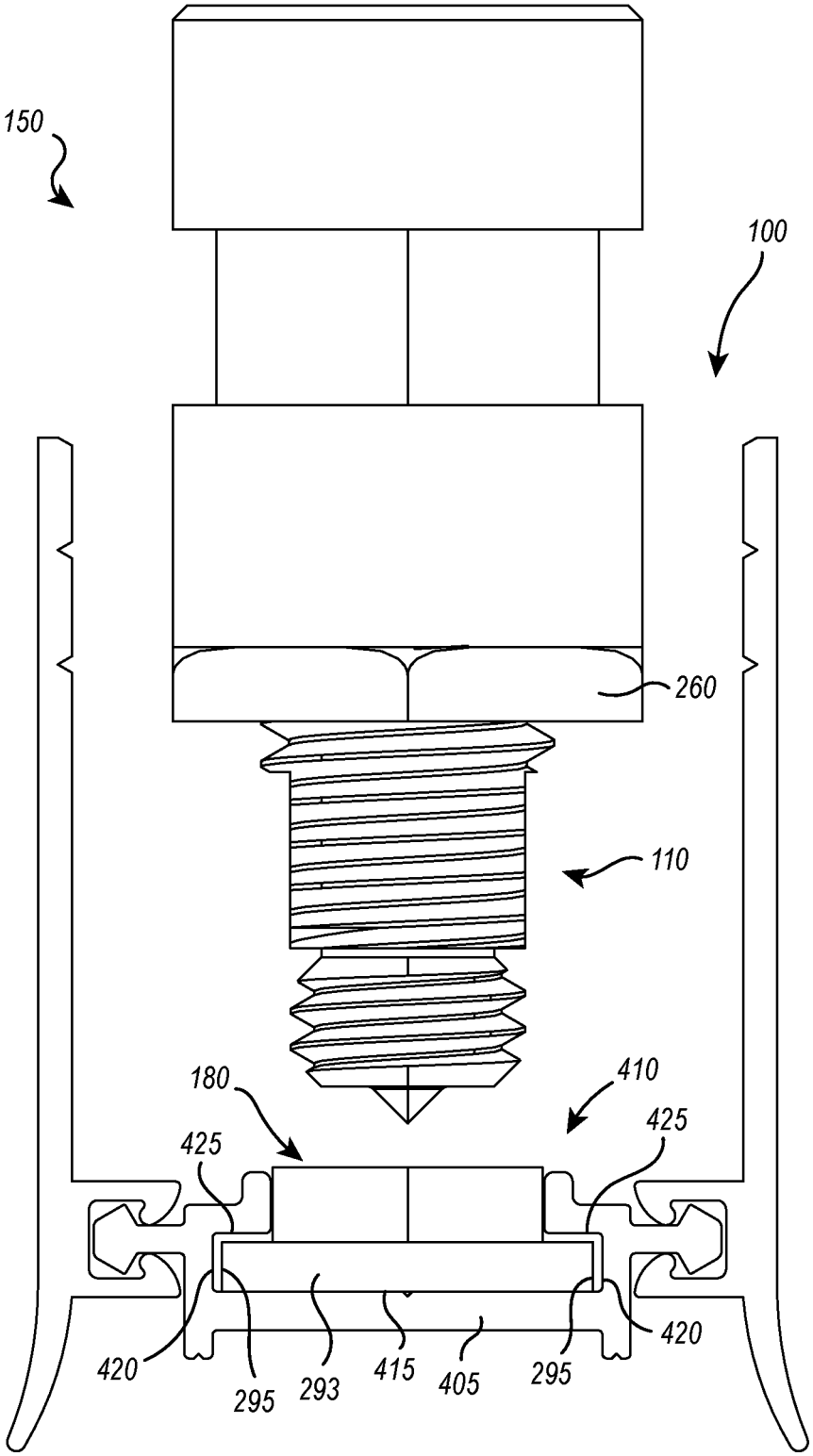
FIG. 4 illustrates an end view of a base track and a leveling stud, a leveling collar, and a positioning nut of a prefabricated wall module leveling assembly, in accordance with implementations of the present disclosure.

FIG. 4 illustrates an end view of a base track 405 and components of a prefabricated wall module leveling assembly 100. The base track 405 of FIG. 4, in some instances, is a component of a prefabricated wall system that can affix to a floor of an installation space and provide support to prefabricated wall modules of the prefabricated wall system. The base track 405 of FIG. 4 comprises a base track channel 410 defined by a bottom channel wall 415 and opposing side channel walls 420. The base track channel 410 can receive other components of a prefabricated wall system to provide support to the prefabricated wall modules of the prefabricated wall system.

FIG. 4 demonstrates that the base track channel 410 of the base track 405 can receive a positioning nut 180 of a prefabricated wall module leveling assembly 100. For example, FIG. 4 shows that the radial protrusion 293 of the positioning nut 180 can reside within the base track channel 410 of the base track 405. The base track channel 410 can loosely retain the positioning nut 180 within the base track channel with retaining channel walls 425. One will appreciate, in view of the present disclosure, that the positioning nut 180 can be slidable within the base track channel 410 of the base track before the leveling stud 110 is threaded through the positioning nut 180 and secured to the base track 405.

Although FIG. 4 focuses, in some respects, on a positioning nut 180 that includes a single, substantially annular radial protrusion 293 that includes the opposing flatted edges 295, those skilled in the art will recognize, in view of the present disclosure, that a positioning nut 180 can include any number of radial protrusions extending away from the positioning nut opening 285 (e.g., two, three, four, or more radial protrusions). Furthermore, one will appreciate that the annular shape depicted in the present Figures is illustrative only, and non-limiting. For example, a radial protrusion 293 can, in some implementations, include a substantially rectangular shape (or any other shape) that surrounds the positioning nut opening 285.

FIG. 4 depicts the leveling stud 110 threaded within the leveling collar 150 but not threaded within the positioning nut 180. Thus, FIG. 4 illustrates a configuration in which the positioning nut 180 is slidable along the length of the base track 405. Similarly, with the leveling stud 110 threaded through the leveling collar 150 but not the positioning nut 180, the leveling collar 150 and leveling stud 110 can be slidable within a leveling channel 710 of a base extrusion 705 of a prefabricated wall system (see FIG. 7).

Figure 7:
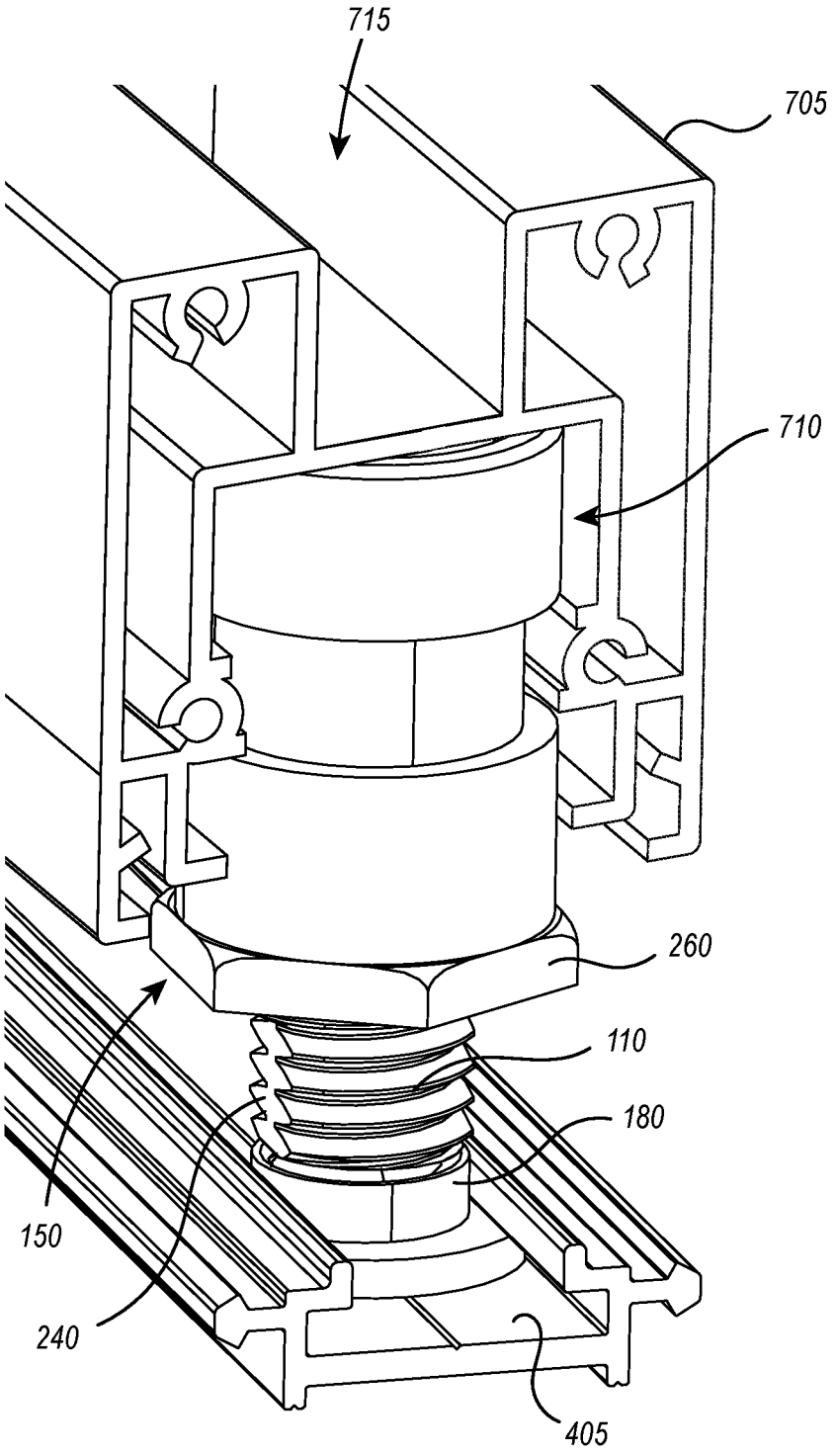
FIG. 7 illustrates a perspective view of an example of a leveling collar of a prefabricated wall module leveling assembly disposed within a base extrusion of a prefabricated wall module, in accordance with implementations of the present disclosure.

For example, FIG. 7 illustrates a perspective view of an example of a leveling collar 150 disposed within a base extrusion 705 of a prefabricated wall module. The base extrusion 705 can include a top channel 715 for receiving a bottom edge of a wall panel of a prefabricated wall module (e.g., a glass or other substrate panel). The base extrusion 705 can also include a leveling channel 710 that can receive and retain a leveling collar 150 therein.

For example, the leveling collar 150 can be loosely retained within the leveling channel 710 such that the leveling collar 150 can slide along the length of the leveling channel 710 of the base extrusion 705. In some instances, vertical extrusions of the prefabricated wall module can prevent the leveling collar 150 from exiting the leveling channel 710 once installed. In this regard, the leveling collar 150 can be slidable along the length of the leveling channel 710.

Other components of a prefabricated wall module (e.g., a wall panel, the vertical extrusions shown in FIGS. 4 through 6, etc.) are omitted from FIG. 7 for simplicity of illustration.

In this regard, before a user advances the leveling stud 110 through the positioning nut 180 within the base track channel 410 (e.g., via a tool engaging with opposing flattened portions 240 of the leveling stud), the components of the prefabricated wall module leveling assembly 100 can be advantageously adjustable (e.g., by sliding) within other components of a prefabricated wall system. By providing components that can slide within channels of a prefabricated wall system before installed, the prefabricated wall module leveling assemblies 100 of the present disclosure can enable a prefabricated wall system to accommodate numerous leveling conditions of installation spaces.

Figure 5:
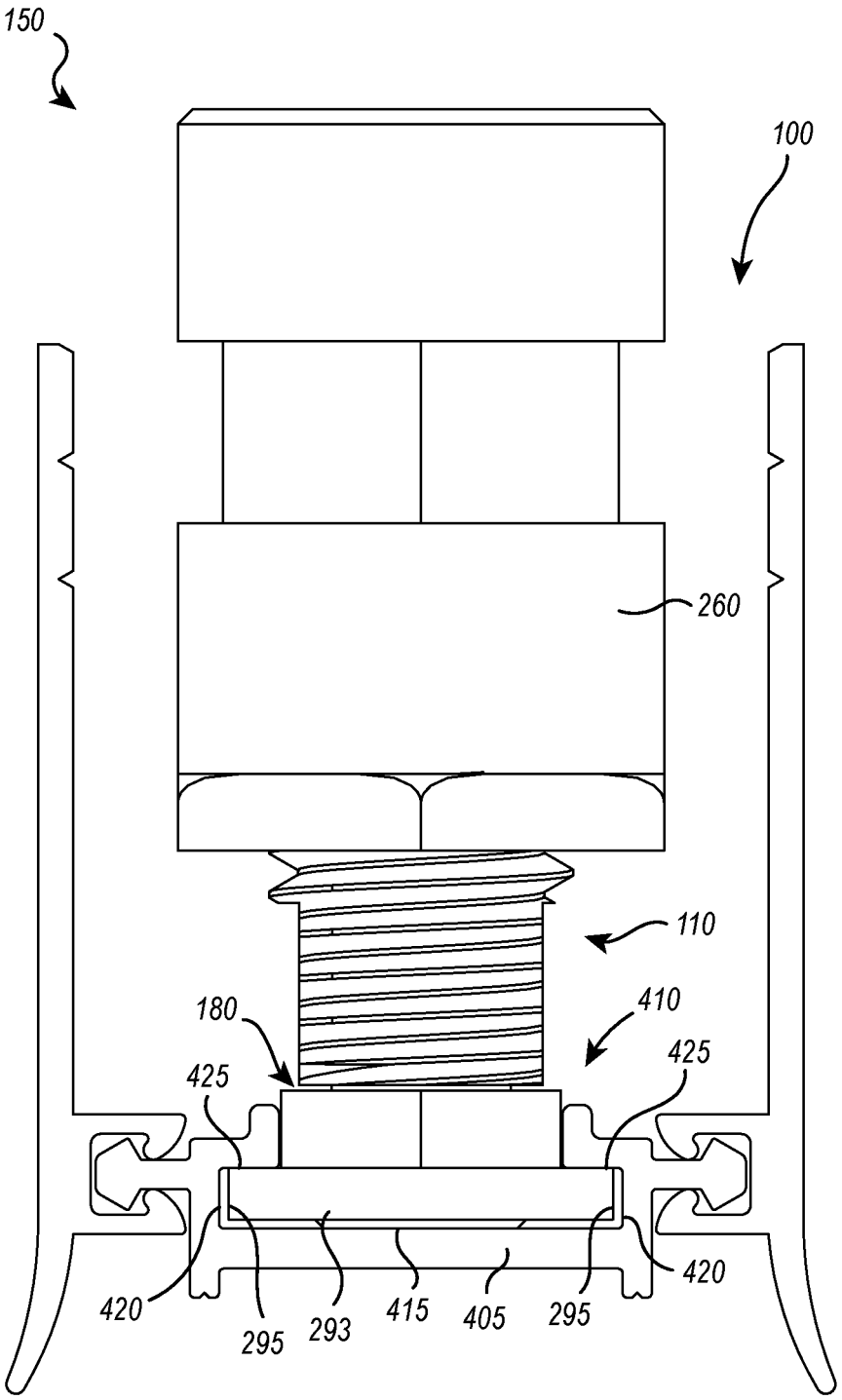
FIG. 5 illustrates an end view of a base track and a leveling stud, a leveling collar, and a positioning nut of a prefabricated wall module leveling assembly, with the leveling stud threaded through the positioning nut, in accordance with implementations of the present disclosure.
Figure 6:
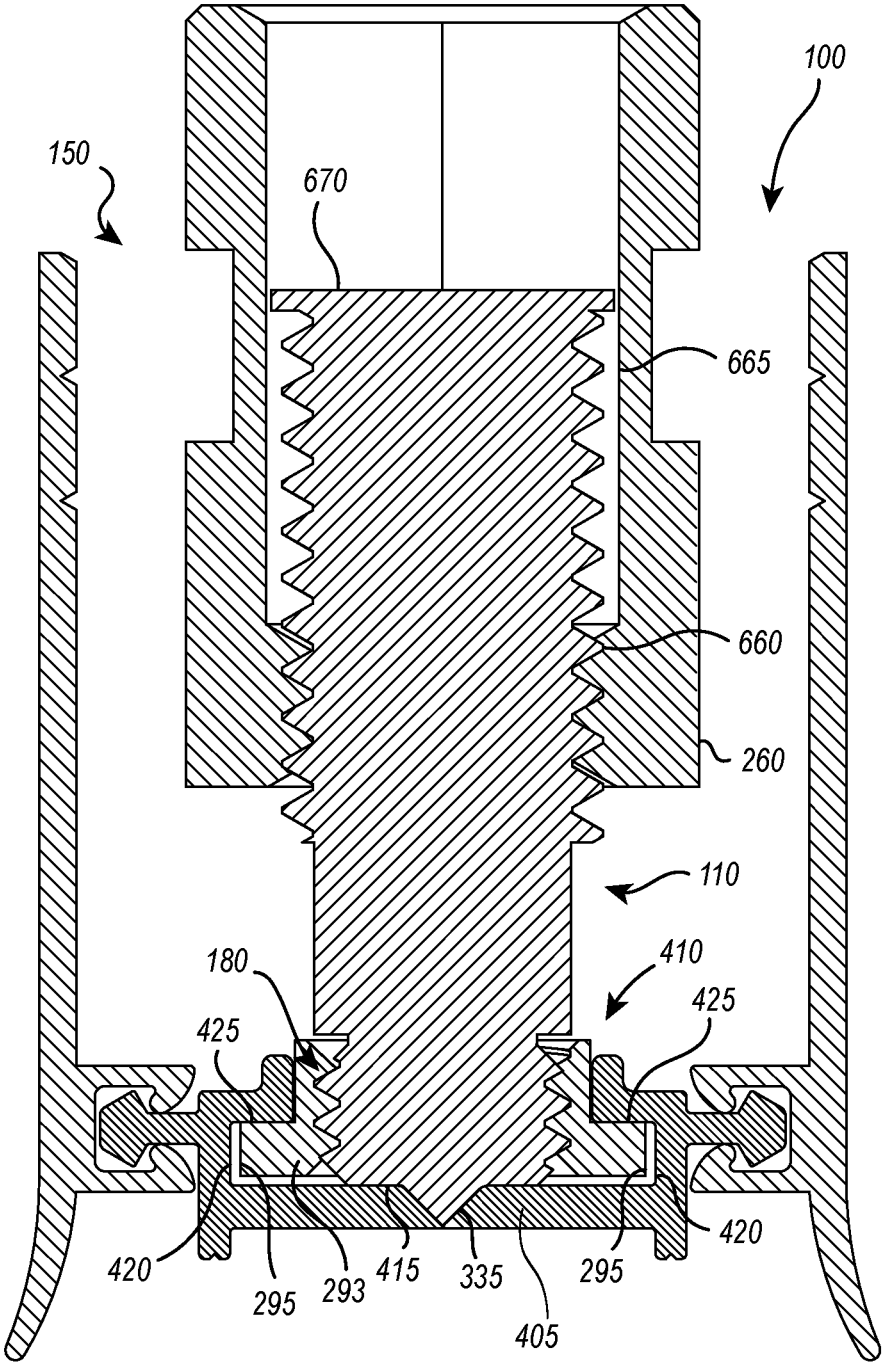
FIG. 6 illustrates a cross-sectional end view of a base track and components of a prefabricated wall module leveling assembly, in accordance with implementations of the present disclosure.

FIGS. 5 and 6 demonstrate that after a user advances the leveling stud 110 through the positioning nut 180 within the base track channel 410, the leveling stud 110 and the positioning nut 180 of the prefabricated wall module leveling assembly 100 can be advantageously locked in place (e.g., by the dig protrusion 335 digging into the bottom channel wall 415) relative to the base track 405. By providing components that can lock in place within the base track channel 410 after being slidably adjustable, the prefabricated wall module leveling assemblies 100 of the present disclosure can enable a prefabricated wall system to provide stability and prove suitable in installation environments that experience seismic activity and/or other vibration events.

FIG. 5 depicts the leveling stud 110 threaded within both the leveling collar 150 and the positioning nut 180. Thus, FIG. 5 illustrates a configuration in which the positioning nut 180 is no longer slidable along the length of the base track 405 and/or the prefabricated wall module of a prefabricated wall system.

FIG. 6 illustrates a cross-sectional end view of the configuration depicted in FIG. 5. Accordingly, FIG. 6 illustrates that when a user threads the first threaded section 230 of the leveling stud 110 into the positioning nut opening 285 of the positioning nut 180, the dig protrusion 335 of the leveling stud 110 can dig into the bottom channel wall 415 of the base track channel 410 of the base track 405.

Furthermore, FIG. 6 shows that when a user threads the first threaded section 230 of the leveling stud 110 into the positioning nut opening 285 of the positioning nut 180, the flat bottom surface 330 of the leveling stud 110 can abut the bottom channel wall 415 of the base track channel 410 of the base track 405.

Additionally, one will appreciate, in view of the present disclosure, that when a user threads the first threaded section 230 of the leveling stud 110 into the positioning nut opening 285 of the positioning nut 180, the opposing flattened edges 295 of the positioning nut 180 can abut the side channel walls 420 of the base track channel 410 of the base track 405 (although this instance is not explicitly shown in FIGS. 5 and 6).

FIG. 6 also illustrates that the leveling collar 150 can include a threaded section 660 that has interior threads that correspond to the threads of the second threaded section 235 of the leveling stud 110. In this manner, as indicated above, a user can advance or retract the leveling collar 150 along the leveling stud 110 by rotating the leveling collar 150 about the leveling stud 110 (e.g., utilizing tool interface 260 of the leveling collar 150).

One will appreciate that after a user threads the first threaded section 230 of the leveling stud 110 into the positioning nut opening 285 of the positioning nut 180 (according to the configuration at least partially depicted in FIGS. 5 and 6), the interfacing between the base track 405, the positioning nut 180, and the leveling stud 110 can provide static frictional force.

For example, the flat bottom surface 330 and the dig protrusion 335 of the leveling stud 110 can interface with the bottom channel wall 415 of the base track 405, the opposing flattened edges 295 of the radial protrusion 293 of the positioning nut 180 can interface with the side channel walls 420 of the base track 405, and/or the first threaded section 230 of the leveling stud can interface with the interior threads 290 of the positioning nut 180.

In some instances, the interfaces between the foregoing components after a user threads the first threaded section 230 of the leveling stud 110 through the positioning nut opening 285 of the positioning nut 180 can provide sufficient static frictional force to prevent the leveling stud 110 from further rotations while a user rotates the leveling collar 150 about the leveling stud 110 (e.g., via tool interface 260 of the leveling collar 150).

Accordingly, the interfacing between the base track 405, the positioning nut 180, and the leveling stud 110 can provide sufficient static frictional force to enable the leveling collar 150 to rotate about the leveling stud 110 to adjust the leveling height of the leveling collar 150 and a prefabricated wall module above the leveling collar 150 with respect to the leveling stud 110 (and the base track 405 and the floor to which the base track 405 can be attached, see FIG. 7).

FIG. 6 also illustrates that the leveling collar 150 can include an unthreaded section 665 that has a diameter that is greater than the diameter of the second threaded section 235 and the top end 220 of the leveling stud 110. Furthermore, FIG. 6 illustrates that the top end 220 of the leveling stud 110 can include a limiter 670 that has a diameter that is greater than the second threaded section. The limiter 670 can be configured to prevent the threaded section 660 of the leveling collar 150 from ascending above the second threaded section 235.

Put differently, the limiter 670 can prevent the second threaded section 235 from threading through the threaded section 660 of the leveling collar 150. Accordingly, the limiter 670 can prevent the leveling collar 150 (and any prefabricated wall module above the leveling collar, see FIG. 7) from reaching unstable/unsafe leveling heights (e.g., where the second threaded section 235 and the threaded section 660 interface at an insufficient number of threads, such as one thread).

Those skilled in the art will appreciate, in view of the foregoing disclosure, that users (e.g., manufacturers, designers, assemblers, building proprietors/occupiers, etc.) can receive and/or implement the components of prefabricated wall module leveling assemblies described herein in a variety of ways.

In one non-limiting example, a user can receive the base track 405 and an accompanying ceiling track for installation into the interior installation space. A user can then affix the base track 405 and ceiling track to the floor and ceiling, respectively, of the interior installation space (e.g., by screws). The base track 405 can include one or more (e.g., two) positioning nuts 180 slidably disposed within the base track channel 410 of the base track 405. In some instances, a user can modify the ceiling and/or base tracks 405 before affixing them to the installation space (e.g., by cutting them to a desired length).

A user can also receive a prefabricated wall module having a base extrusion 705 that includes one or more (e.g., two) leveling collars 150 slidably disposed within a leveling channel 710 of the base extrusion 705. The one or more leveling collars 150 can each have a leveling stud 110 threaded through leveling collar opening(s) 255 of the leveling collar(s) 150.

Furthermore, a user can secure the prefabricated wall module to the ceiling track and position the prefabricated wall module over the base track 405. A user can then slide the leveling collar(s) 150 and leveling stud(s) 110 of the prefabricated wall module to a desired position (e.g., proximate to or abutting opposing vertical extrusions of the prefabricated wall module) within the leveling channel 710 of the base extrusion 705 of the prefabricated wall module.

Correspondingly, a user can also slide the positioning nut(s) 180 within the base track channel 410 of the base track 405 into position beneath the leveling collar(s) 150 and leveling stud(s) 110 within the base extrusion 705 of the prefabricated wall module.

With the components of the prefabricated wall module leveling assembly 100 thus positioned, a user can thread the leveling stud(s) 100 (e.g., a first threaded section 230 thereof) into the threaded positioning nut opening(s) 285 of the positioning nut(s) 180. In some instances, a user can employ a wrench (e.g., an open-end wrench, such as a ½-inch wrench) to engage with opposing flattened portions 240 of the leveling stud 110 to rotate the leveling stud 110, causing the first threaded section 230 of the leveling stud to thread into the interior threads 290 of the positioning nut 180.

Threading the leveling stud 110 through the positioning nut 180 can cause the dig protrusion 335 of the leveling stud 110 to dig into the bottom channel wall 415 of the base track 405, bringing the flat bottom surface 330 of the leveling stud 110 into abutment with the bottom channel wall 415 of the leveling channel. The friction that results from this interfacing can secure the positioning of the leveling stud 110 and positioning nut 180 with respect to the base track 405.

A user can then rotate the leveling collar 150 about the secured leveling stud 110 (e.g., via the tool interface 260 of the leveling collar 150) to adjust the leveling height of the leveling collar 150 and the prefabricated wall module that houses the leveling collar 150 within the base extrusion 705 thereof.

Those skilled in the art will recognize, in view of the present disclosure, that any denotations of first, second, front, back, top, bottom etc. (e.g., top end, bottom end, first threaded section, second threaded section, etc.) in the present disclosure can be somewhat arbitrary and are provided for illustrative purposes and for ease of description. Thus, any ordinal or other denotations included herein are in no way limiting of the present disclosure. One will appreciate that any other denotations not explicitly included herein are within the scope of this disclosure.

The present invention may be embodied in other specific forms without departing from its spirit or essential characteristics. The described embodiments are to be considered in all respects only as illustrative and not restrictive. The scope of the invention is, therefore, indicated by the appended claims rather than by the foregoing description. All changes which come within the meaning and range of equivalency of the claims are to be embraced within their scope.

We claim:

1. A prefabricated wall system, comprising:

a prefabricated wall module, comprising:

a wall panel comprising a bottom edge, a top edge, and opposing vertical edges;

vertical extrusions that receive and secure to the opposing vertical edges; and a base extrusion that receives and secures to the bottom edge, the base extrusion comprising a leveling channel;

a leveling collar retained within the leveling channel, the leveling collar being slidable along a length of the leveling channel, the levelling collar comprising:

a leveling collar opening extending through the leveling collar, the leveling collar opening comprising:

an unthreaded section; and a threaded section, wherein the leveling collar is rotatable within the leveling channel about an axis extending through the leveling collar opening; and a leveling stud, comprising:

a threaded body, comprising:

a first threaded section;

a second threaded section above the first threaded section, wherein threads of the second threaded section are threaded through the threaded section of the leveling collar and the first threaded section extends below the leveling collar, and wherein the leveling collar is rotatable about the leveling stud within the leveling channel about the axis extending through the leveling collar opening to facilitate height adjustment of the prefabricated wall module;

a top end; and a bottom end, the threaded body extending between the top end and the bottom end, the bottom end comprising:

a flat bottom surface; and a dig protrusion extending from a portion of the flat bottom surface.

2. The prefabricated wall system of claim 1, further comprising:

a base track, comprising:

a base track channel defined by a bottom channel wall and opposing side channel walls; and a positioning nut disposed within the base track channel, comprising:

a positioning nut opening extending through the positioning nut, the positioning nut opening comprising interior threads that correspond to threads of the first threaded section of the leveling stud.

3. The prefabricated wall system of claim 2, wherein:

the dig protrusion of the leveling stud is configured to dig into the bottom channel wall of the base track when the first threaded section of the leveling stud is threaded into the positioning nut opening, and the flat bottom surface is configured to abut the channel surface when the leveling stud is threaded into the positioning nut of the base track.

4. The prefabricated wall system of claim 3, wherein:

the positioning nut further comprises one or more radial protrusions extending from the positioning nut opening within the base track channel, the one or more radial protrusions comprising:

opposing flattened edges on opposing lateral sides of the positioning nut, and when the first threaded section of the leveling stud is threaded into the positioning nut opening:

the dig protrusion of the leveling stud digs into the bottom channel wall of the base track, the flat bottom surface of the leveling stud abuts the bottom channel wall of the base track, the opposing flattened edges of the positioning nut abut the opposing side channel walls of the base track, and an interfacing between the base track, the positioning nut, and the leveling stud provides sufficient friction to enable the leveling collar to rotate about the leveling stud to adjust a leveling height of the leveling collar and the prefabricated wall module with respect to the leveling stud.

5. The prefabricated wall system of claim 4, wherein:

the one or more radial protrusions of the positioning nut comprise opposing flattened edges on opposing lateral sides of the positioning nut; and the opposing flattened edges are configured to abut opposing channel walls of the base track channel when the first threaded section of the leveling stud is threaded into the positioning nut opening to prevent rotation of the positioning nut within the base track channel.

6. The prefabricated wall system of claim 1, wherein:

the dig protrusion is configured to dig into a channel surface of a base track of the prefabricated wall system when the leveling stud is threaded into a positioning nut, and the flat bottom surface is configured to abut the channel surface when the leveling stud is threaded into the positioning nut of the base track.

7. The prefabricated wall system of claim 6, wherein:

the top end of the threaded body comprises a limiter having a diameter that is greater than the diameter of the second threaded section; and the limiter is configured to prevent the second threaded section from threading through the leveling collar.

8. The prefabricated wall system of claim 1, wherein:

a diameter of the second threaded section is greater than a diameter of the first threaded section.

9. The prefabricated wall system of claim 1, wherein:

the first threaded section is configured to thread into corresponding threads of a positioning nut of a base track.

10. The prefabricated wall system of claim 9, wherein:

a segment of the second threaded section comprises opposing flattened portions on opposing lateral sides of the second threaded section; and the opposing flattened portions providing engagements surfaces for engaging with a tool.

11. The prefabricated wall system of claim 10, wherein the tool is an open-end wrench.

12. The prefabricated wall system of claim 1, wherein the top end of the threaded body omits a tool engagement interface.

13. The prefabricated wall system of claim 1, wherein the dig protrusion omits threads.

14. The prefabricated wall system of claim 1, further comprising:

a positioning nut having a positioning nut opening extending through the positioning nut;

wherein the positioning nut opening comprises interior threads that correspond to threads of the first threaded section of the leveling stud.

15. The prefabricated wall system of claim 14, wherein:

the positioning nut further comprises one or more radial protrusions extending from the positioning nut opening; and the one or more radial protrusions are configured to reside within a base track channel of a base track of a prefabricated wall system.

16. The prefabricated wall system of claim 1, wherein:

the unthreaded section of the leveling collar has a diameter greater than the diameter of the second threaded section of the leveling stud; and the threaded section of the leveling collar has interior threads that correspond to threads of the second threaded section of the leveling stud.

17. The prefabricated wall system of claim 1, wherein the leveling collar is configured to reside within a leveling channel of a base extrusion of a prefabricated wall module.

18. The prefabricated wall system of claim 1, wherein:

the top end of the leveling stud comprises a limiter having a diameter that is greater than the diameter of the second threaded section and smaller than the diameter of the unthreaded section of the leveling collar, and the limiter is configured to prevent the top end of the leveling stud from advancing through the threaded section of the leveling collar.

19. The prefabricated wall system of claim 1, wherein the leveling collar further comprises a tool interface at least partially surrounding a bottom portion of the leveling collar.

20. A prefabricated wall system, comprising:

a prefabricated wall module, comprising:

a wall panel comprising a bottom edge, a top edge, and opposing vertical edges;

vertical extrusions that receive and secure to the opposing vertical edges; and a base extrusion that receives and secures to the bottom edge, the base extrusion comprising a leveling channel;

a leveling collar retained within the leveling channel, the leveling collar being slidable along a length of the leveling channel, the levelling collar comprising:

a leveling collar opening extending through the leveling collar, the leveling collar opening comprising:

an unthreaded section; and a threaded section; and a leveling stud, comprising:

a threaded body, comprising:

a first threaded section;

a second threaded section above the first threaded section, wherein threads of the second threaded section are threaded through the threaded section of the leveling collar and the first threaded section extends below the leveling collar;

a top end; and a bottom end, the threaded body extending between the top end and the bottom end, the bottom end comprising:

a flat bottom surface; and a dig protrusion extending from a portion of the flat bottom surface, the dig protrusion forming a point extending from the flat bottom surface for digging into adjacent material.

* * * * *